US007098597B2

(12) United States Patent
Inaoka et al.

(10) Patent No.: US 7,098,597 B2
(45) Date of Patent: Aug. 29, 2006

(54) XENON LAMP

(75) Inventors: Norihiro Inaoka, Kakogawa (JP); Katsuoki Miyasu, Himeji (JP); Kyosuke Fujina, Shiso-gun (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 72 days.

(21) Appl. No.: 10/810,595

(22) Filed: Mar. 29, 2004

(65) Prior Publication Data

US 2004/0189206 A1 Sep. 30, 2004

(30) Foreign Application Priority Data

Mar. 31, 2003 (JP) ..... 2003-093865

(51) Int. Cl.
*H01J 17/10* (2006.01)

(52) U.S. Cl. ..... 313/631; 313/632; 313/637

(58) Field of Classification Search ..... 313/631, 313/574, 576, 621, 632, 643, 622, 637
See application file for complete search history.

(56) References Cited

U.S. PATENT DOCUMENTS

| | | | | |
|---|---|---|---|---|
| 3,543,076 | A * | 11/1970 | Haslund | 313/30 |
| 5,929,565 | A * | 7/1999 | Mayama et al. | 313/631 |
| 5,986,402 | A * | 11/1999 | Narita et al. | 313/620 |
| 6,051,929 | A * | 4/2000 | Genz et al. | 313/639 |
| 6,573,658 | B1 * | 6/2003 | Sakai et al. | 313/642 |
| 6,614,186 | B1 | 9/2003 | Mehr et al. | |
| 2001/0035719 | A1 * | 11/2001 | Mehr et al. | 313/631 |
| 2001/0038265 | A1 * | 11/2001 | Nishida | 313/631 |
| 2002/0074943 | A1 * | 6/2002 | Mehr et al. | 313/631 |

FOREIGN PATENT DOCUMENTS

| | | |
|---|---|---|
| JP | 04-179045 | 6/1992 |
| JP | 05-054854 | 3/1993 |
| JP | 06-013029 | 1/1994 |
| JP | 06013029 A * | 1/1994 |
| JP | 2002-093363 | 3/2002 |

* cited by examiner

*Primary Examiner*—Ashok Patel
*Assistant Examiner*—Christopher M. Raabe
(74) *Attorney, Agent, or Firm*—David S. Safran

(57) ABSTRACT

A xenon lamp in which fluctuation of the arc can be suppressed and the time until formation of the flicker phenomenon delayed by having an anode with a flattened or rounded anode tip, a rounded or flattened back end; a portion with a diameter that gradually increases from the anode tip toward the back end of the anode; a portion with a decreasing diameter located behind the portion with the increasing diameter of an axial length which is greater than the length in the axial direction of the portion with an increasing diameter; and a portion with a maximum outside diameter formed in a transition area between the portion with the increasing diameter and the portion with a decreasing diameter, and that the transition area between the portion with the increasing diameter and the portion with the decreasing diameter is formed to be continuous.

10 Claims, 7 Drawing Sheets

| | Inventive example 1 | Comparative example |
|---|---|---|
| operation for less than 1 hour |  |  |
| operation for 750 hours |  |  |

Inventive example

Comparative example

XENON LAMP

BACKGROUND OF THE INVENTION

1. Field of the Invention

The invention relates to a discharge lamp of the short arc type which is used for a projection light source and for a projector. The invention relates particularly to a xenon discharge lamp of the short arc type of the direct current operation type.

2. Description of the Related Art

A so-called discharge lamp of the short arc type having an anode and a cathode opposite one another is used as a light source lamp in a projection device for a demonstration and in a projector device. In this discharge lamp the so-called flicker phenomenon arises in which the deflection of the arc increases in the course of operation of the lamp. When the flicker phenomenon occurs, the images projected onto the screen flicker; which is perceived as unpleasant in visual observation. When the flickering occurs, the short arc lamp is replaced and this time that flickering is confirmed is referred to as the flicker service life.

It is known that the above described flicker phenomenon is caused by electrode wear and turbulence of the gas flow in the arc tube. Conventionally, for lamps used for the above described purposes, various techniques have been proposed for suppressing the flicker phenomenon.

The following techniques are known:

- a technique in which the tip area of the cathode is carbonized, thus the motion of the emitter substance to the tip area of the cathode is accelerated and thus the wear of the tip area of the cathode is reduced, as described in Japanese Patent No. 2782611.
- a technique in which the cathode material, with tungsten as the main component, is changed so that the amount of change of shape is reduced and thus the stability of the arc is maintained, as described in Japanese Patent No. 2851727.

Another technique in which electrodes for a flicker-free lamp are produced is the technique described in Japanese Patent Application No. 2002-93363.

Additionally, a technique is also known in which in order to stabilize the gas flow in the arc tube in the upper area of the arc tube an outside cooling device is employed for providing cooling air which cools, convection is suppressed and the arc is stably maintained. The use of the outside cooling device, however, often causes enlargement of the light source device which is considered undesirable. Furthermore, the gas pressure within the arc tube is reduced by excessive cooling.

Another technique is known in which by improving the electrode shape the influence of convection is reduced. For example, in U.S. Pat. No. 6,614,186 a short arc lamp is described in which for the anode in the connecting area between the forward region of the tip surface and the body there is a peripheral projection with a V-shaped cross section.

In a projector device with a high light intensity, such as a DMD (digital mirror device), having pixels of the reflection type of liquid crystals and the like, a xenon lamp of the short arc type with a kW range, high radiance and high light intensity filled with xenon gas as the discharge medium is advantageously used. This xenon lamp also suffers from the lack of durability of the lamp due to the formation of flicker.

Recently there has been a demand for especially high radiance in a small DMD with high precision. The xenon lamps are becoming common in such uses and those lamps have the distance between the electrodes which is becoming smaller and smaller and, further, the gas filling pressure has been increased, e.g., to $\geqq 4\times10^6$ Pa (computed at 25° C.). When the distance between the electrodes becomes smaller, a temperature increase of the cathode results which leads to premature wear. In particular, in a xenon lamp turbulence of the gas flow arises principally in the arc tube. When a change in convection occurs, the arc is induced to fluctuate. In these xenon lamps, as a result of the increased of the gas pressure, the effect of convection becomes greater which results, due to the mutual action and synergistic effect of both the cathode wear and the convection turbulence, in the flicker phenomenon occurring prematurely.

In a short arc lamp used in the above lamps, it has been discovered by the inventors that an improvement of convection within the arc tube occurs, and, further, that a relationship between the convection and flicker phenomenon exists which is described below. It is noted that in this description, the lamp is limited only to a short arc lamp of the type used in the above described field, i.e., to a short arc lamp which is operated with a horizontal position of the tube axis of the lamp. Therefore, this description is not pertinent for a lamp operated with a vertical position.

FIGS. 12(*a*) and 12(*b*) show, in an enlarged view, the state of convection of a xenon lamp in the prior art. Specifically, in FIG. 12(*a*) the lines between the anode 81 and the cathode 82 constitute the arc shape, and the arrows represent the state of gas convection within the arc tube 83. Since the speed of the added gas is accelerated by the pressure difference between the front side of the cathode spot and the vicinity of the anode remote from the cathode 82 in a direction toward the anode 81, the gas advances between the electrodes essentially parallel to the arc tube axis. The gas which has been accelerated by the arc flows along the essentially cylindrical anode 81 to behind this anode 81. At the same time, the gas tries to move to above the arc tube since the gas is heated by the arc.

In the initial stage, the gas flow—in the direction of the arc tube axis along the portion of the body having a uniform diameter which constitutes the maximum outside diameter of the anode 81—moves away from the anode 81 (hereinafter also called simply "deportion"), returns again to the middle area of the arc tube 83 which makes the gas flow turbulent. Influenced by the turbulence of this flow, a fluctuation occurs in the arc, although the amount of it need not be problematical. This fluctuation of the arc accelerates the wear and drying-out of the emitter of the cathode 82.

FIG. 12(*b*) illustrates that over the course of operation of the lamp the tip of the cathode 82 is heavily worn and the emitter substance is also dried out. The result of which is that the fluctuation of the arc gradually increases towards the end of the lamp service life. As a result, at the start of operation, the gas flow which had deportioned from the body of the anode 81 now becomes turbulent due to the greater fluctuation of the arc, and the gas flow begins to deportion in the corner area 81 a on the border between the tapering region of the tip area of the anode 81 and the region of the anode with the maximum outside diameter. The turbulence of gas flow convection in the vicinity of the arc is therefore greatly influenced by the fluctuation of the arc. Consequently, the arc together with the cathode enters an extremely unstable state towards the end of the service life.

As was described above, due to the influence of the wear of the cathode, the drying-out of the emitter substance and the turbulence of gas flow convection, the flicker phenomenon arises prematurely which in turn leads to a shortening of the service life of the lamp. In the prior art, a plurality of measures had been taken to eliminate electrode damage. Currently, however, the situation is such that even using the electrode above it is difficult to prolong the flicker service life.

Still further when a cooling device is used for improving convection in the above described manner, the operating property of the lamp can still changes, and solution is also difficult to implement in practice.

In the above described U.S. Pat. No. 6,614,186, upon placing a projection in the electrode tip area of the arc tube an eddy is formed such that in the vicinity of the arc the speed of the gas flow is reduced, and thus the effect of convection is thereby reduced. However, the flow energy is weakened by the generation of the eddy due to the projection. Since the flow departs from the projection area and since turbulence begins to form in the flow after departure, arc fluctuations arise, towards the end of the service life of the lamp, due to the turbulence of convection when cathode wear occurs. Ultimately, the flicker service life is not prolonged.

SUMMARY OF THE INVENTION

A primary object of the invention is to provide a xenon lamp in which even towards the end of the service life the fluctuation of the arc is suppressed and the time until formation of the flicker phenomenon is prolonged, i.e. the flicker service life increased.

The above described object is achieved by the current invention in which the xenon lamp includes the following features:

- an arc tube in which both ends are provided with a side tube portion;
- xenon gas is added within the arc tube;
- an opposed anode and a cathode are located within the arc tube at a given distance from one another; and
- electrode rods, in which one is connected to the back end of the anode and the other is connected to the back end of the cathode, and further, the above described anode includes the following elements:

- a curved surface or a plane on the anode tip and on the back end of the anode;
- a portion with an increasing diameter that gradually increases from the anode tip to the rear;
- a portion with a decreasing diameter formed such that, behind the portion with the increasing diameter, the diameter gradually decreases and the length in the axial direction is greater than the length in the axial direction of the portion with an increasing diameter; and
- a portion with a maximum outside diameter formed on the boundary between the portion with the increasing diameter and the portion with the decreasing diameter, and the vicinity of the boundary between the portion with the increasing diameter and the portion with the decreasing diameter is effected gradually.

The above-indicated object of the invention is also advantageously achieved when L>D where the length in the axial direction from the anode tip to the back end of the anode is labeled L (mm) and the diameter of the above described portion with the maximum outside diameter is labeled D (mm).

The object of the invention is furthermore advantageously achieved when the diameter of the portion with the increasing diameter increases in a tapering manner, the diameter of the portion with a decreasing diameter decreases in a tapering manner and the surface in the vicinity of the boundary between the portion with the increasing diameter and the portion with the decreasing diameter is formed as an essentially arc-shaped rotationally curved surface.

The object of the invention is also advantageously achieved when the surface of the portion with the increasing diameter and the surface of the portion with the decreasing diameter are each formed by an essentially arc-shaped rotationally curved surface and that the relation R3<R4 is satisfied when the radius of curvature of the curved surface of the portion with the increasing diameter is labeled R3 and the radius of curvature of the curved surface of the portion with the decreasing diameter is labeled R4.

The object is furthermore advantageously achieved when the diameter of the portion with an increasing diameter increases in a tapering manner, the surface of the portion with a decreasing diameter is formed by an essentially arc-shaped rotationally curved surface and the surface of the back end of the portion with the increasing diameter is formed by an essentially arc-shaped rotationally curved surface.

The object of the invention also advantageously achieved when the surface of the portion with an increasing diameter is formed by an essentially arc-shaped rotationally curved surface and the diameter of the portion with a decreasing diameter decreases in a tapering manner.

Finally, the object is advantageously achieved when the back end of the anode is provided with a portion with a uniform diameter.

With the anode of the invention, the gas flow which has been accelerated in the arc plasma is allowed to flow to the rear along the anode smoothly, i.e. unperturbed, and the section of the gas flow returning to the vicinity of the arc is dramatically lengthened, the speed of the gas flow is reduced and the effect on the arc is diminished in comparison with the conventional short arc type lamp. It is therefore ideal that the anode is formed in the shape of gas flow lines, for example as a wing-shape. However the ideal shape is difficult to produce in practice, but no problem arises with the anode of the invention which achieves smooth motion of the gas flow to behind the anode.

The invention is described in further detail below with reference to the accompanying drawings.

DETAILED DESCRIPTION OF THE INVENTION

Figure 1:
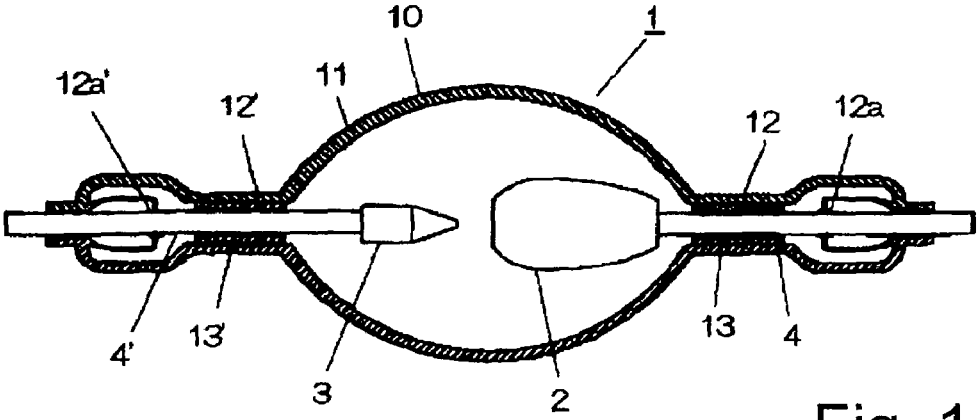
FIG. 1 shows a section in the axial direction of the tube of a xenon lamp of the invention.
Figure 2:
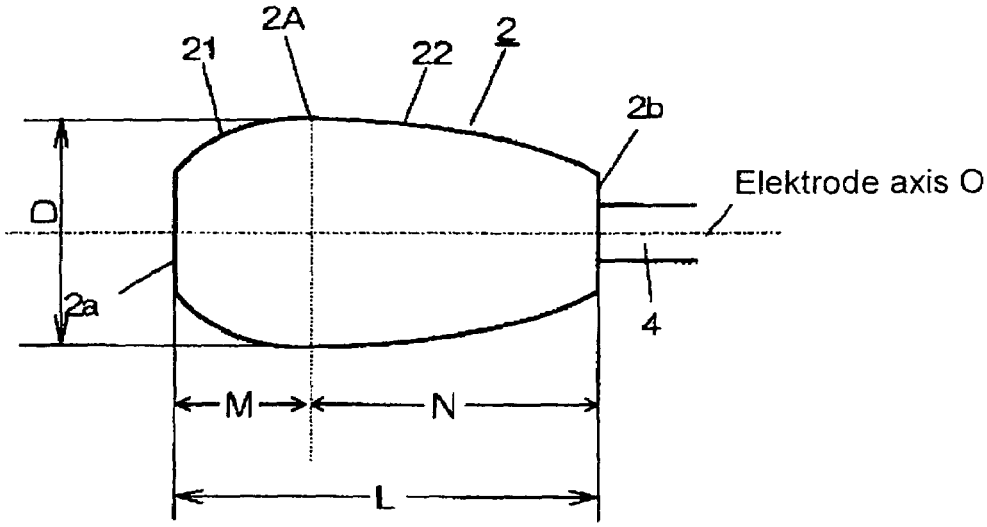
FIG. 2 is an enlarged a side view of the anode as shown in FIG. 1.

FIG. 1 is a partial section which shows a xenon lamp of the short arc type of the invention and which was cut in the axial direction of the tube. FIG. 2 is a schematic side view of the anode as shown in FIG. 1. FIG. 1 shows a xenon lamp with a nominal power consumption of 160 A which is operated in a horizontal position of the lamp tube axis. A xenon lamp 1 has a silica glass arc tube 10 which is filled with $1\times10^6$ Pa (computed at 25° C.) xenon gas and an essentially oval arc tube portion 11 in which there are positioned an opposed anode and cathode at a spaced distance of roughly 8 mm. One electrode rod 4 is connected to this anode 2. Another electrode rod 4' is connected to the cathode 3. The electrode rods 4, 4' each are composed of a tungsten material, are inserted into the side tube portions 12, 12' which border the two sides of the arc tube portion 11, and are welded in weld portions 12*a*, 12*a*' on graded glass portions which are intended to bring the coefficient of thermal expansion to near that of the electrode rods 4, 4'. The components 13, 13' fix the electrode rods 4, 4', which are inserted into the openings and are located in the middle, and are attached to the electrode rods 4, 4'.

In FIG. 2, the anode 2 has essentially a columnar shape which taken as a whole has as a middle in the axial direction of the electrode. The material comprising the anode 2 is tungsten. In this embodiment, only the main portion (column-shaped portion) of the electrode on the anode side is labeled the "anode", the electrode rod 4 being excluded from the discussion. However, in the process of producing the anode, the separate portions of the electrode are connected to one another. Each portion can of course also be formed from a unitary part by processing, such as on a lathe bench or the like.

A portion 21 with an increasing diameter is formed on the tip surface 2*a* positioned opposite a cathode 3, and has a shape in which the outside diameter increases to the rear of the anode in a gradually curving manner, i.e. the portion 21 becomes narrower in the direction toward the tip in a gradually curving manner. The electrode rod 4 is mounted on the back end 2*b* of the anode 2 by insertion into an opening located in the middle of the anode and is formed as a single piece.

The surface of the portion with an increasing diameter 21 is structured as a rotationally curved surface which, as is shown in FIG. 2, is defined by an arc turned around the electrode axis and is of a spheroidal shape toward the outside. The back end of the portion 21 forms the portion with the maximum outside diameter 2A of the anode. Bordering this portion with a maximum outside diameter 2A is a portion with a decreasing diameter 22 which is formed with a shape in which the outside diameter is reduced to the rear in a still more gradually curving manner, i.e. in which the portion 22 in the direction to the back end 2*b* becomes narrower in a gradually curving manner. The surface of the decreasing diameter portion 22 is defined by a rotationally curved surface which is obtained by turning an arc around the electrode axis and is of a spheroidal toward the outside. In the border area between the portion of the curved area of the surface of the portion 21 with the increasing diameter and the portion 22 of the curved area of the surface of the portion with the decreasing diameter, the portion 2A with the maximum outside diameter is formed. In front of and behind the maximum outside diameter portion 2A, two curved surfaces are shaped passing smoothly one into the other without formation of a discontinuous point.

The portion 22 with the decreasing diameter is formed such that the length N in the axial direction is greater than or equal to ½ of the total length (L) of the anode 2. In this way, the length N is greater than the length M in the axial direction of the portion 21 with the increasing diameter. Therefore, the section of gas flow until the gas flow reaches the portion 22 with a decreasing diameter is short, and which enables gas flow to be effectively induced toward the outer end 2*b* of the arc tube portion 11.

In this embodiment, the border between the portion 21 with the increasing diameter and the portion 22 with the decreasing diameter for the anode 2 is formed fluidly and continuously and the length (N) of the decreasing diameter portion 22 is greater than the length (M) of the increasing diameter portion 21. This results in the gas flow in the axial direction of the electrode being easily captured in the portion with the maximum outside diameter 2A of the anode 2, such that departure of the gas flow occurs less often and the formation of convection to a point behind the anode 2 is accelerated so that stable maintenance of the arc is achieved.

Furthermore, the configuration in which the total length L of the anode 2 is greater than the maximum outside diameter D of the anode, that is, in a side view the anode is wider than it is long, easily enables the gas flow behind the anode 2, while the gas flow does not radially widen to the outside, and the departure of the gas flow only occurs with difficulty.

Figure 3:
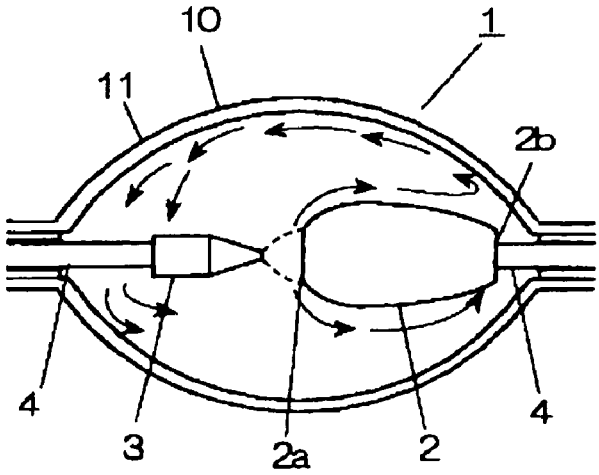
FIG. 3 shows a schematic of the gas flow state during operation of the xenon lamp of the invention.

FIG. 3 is a schematic of the embodiment in which the above described xenon lamp is held and operated such that the tube axis has a horizontal position. The same portions as in FIG. 1 and FIG. 2 are provided with the same reference numbers as in FIGS. 1 and 2.

In FIG. 3 the broken line between the tip of the cathode 3 and the tip of the anode 2 constitutes the arc. With the gas added, the speed of the gas in the vicinity of the cathode 3 is accelerated in the arc direction, i.e., accelerated from the cathode 3 in the direction toward the anode 2, and the gas continues between the electrodes essentially parallel to the tube axis. The gas flows along the anode 2 from the tip 2*a* to the back end 2*b*. At the same time, the gas tries to move upward in the arc tube 10 because it is heated by the arc.

Even when the operating time of the lamp is expiring and the time approaches when the lamp reaches the end of its service life, the gas flow in this embodiment proceeds along the surface of the anode 2 and is routed in the direction to the back end 2*b* because in the increasing diameter portion 21 of the anode 2 a gently running curved surface is formed. That is, the gas flow rarely departs. Because the length in the axial direction of the decreasing diameter portion 22 is greater than that of the increasing diameter portion 21, the gas flow which has passed through the increasing diameter portion 21 keeps constant a certain speed and reaches the decreasing diameter portion 22 where it is deflected in the direction toward the middle of the electrode. As a result, the gas flow begins to be directed toward the outer end of the arc tube 11 without widening in the radial direction. This flow likewise occurs when the end of the service life of the lamp is approaching, i.e., the convection of the gas flow changes only slightly.

When the gas flow reaches the end of the arc tube 11, the gas returns in the vicinity of the outer end of the arc tube 11 along the top side of this arc tube 11 again to the site of the cathode 3. Since a large movement of gas flow occurs in the lengthwise direction, the kinetic energy of the gas flow is sufficiently consumed and the speed of the gas flow is reduced, the gas flow does not cause a fluctuation in the arc, even when returning to the vicinity of the arc. Therefore, employing the anode 2 of this embodiment it becomes possible to avoid the arc fluctuation caused by convection gas flow.

Consequently, even towards the end of the lamp service life the effect of convection is avoided and that the same operating state is maintained as at the start of lamp operation. Further, this occurs even if the electrode wears, and even if the arc shifts into the state in which it fluctuates more frequently. Therefore, the time to the arc fluctuation increases more than in the conventional short arc lamp. Thus, the flicker service life can be prolonged.

Figure 4:
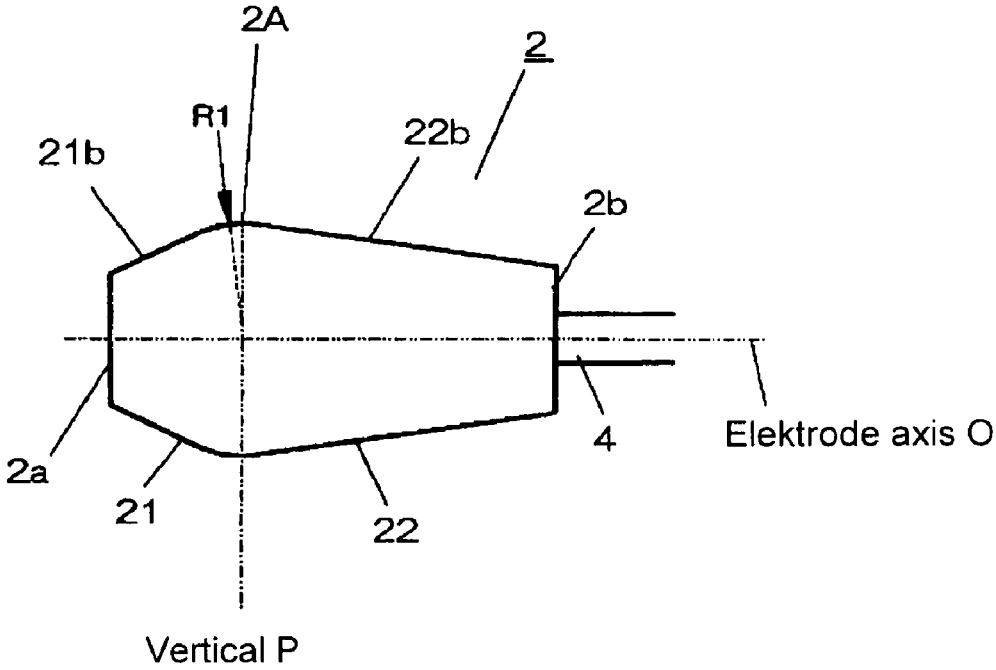
FIG. 4 shows a side view of a second embodiment of the anode.

FIG. 4 is a side view of a second embodiment of the anode of the invention. The same portions as the portions which were described using the above described drawings are labeled with the same reference numbers and are no longer described. As is shown in FIG. 4, in this embodiment both the increasing diameter portion 21 and also the decreasing diameter portion 22 are each provided with obliquely running surfaces (21*b*, 22*b*) with a constant gradient. The increasing diameter portion 21 on its tip has an obliquely running surface 21*b* with a diameter which increases essentially linearly. The decreasing diameter portion 22 has an obliquely running surface 22*b* which essentially linearly reduces its diameter proceeding from the portion with the maximum outside diameter 2A. The vicinity of the boundary between the increasing diameter portion 21 and the decreasing diameter portion 22 is formed by a spheroidal curved surface portion with a cross section which is an arc (R1). In this curved surface portion, the portion with the maximum outside diameter 2A is formed.

For this anode with the portion with the increasing diameter and the portion with the decreasing diameter, by forming a gently running curved surface on the boundary between the portion with the increasing diameter and the portion with the decreasing diameter, the departure of the gas flow can be made difficult and gas convection allowed to flow smoothly to the end of the anode 2. In this embodiment, the curved surface portion is formed by a curved surface with a single curvature. However, when the surface of the vicinity of this boundary is formed to be gently running, it can be formed from several curved surfaces with different curvatures.

Figure 5:
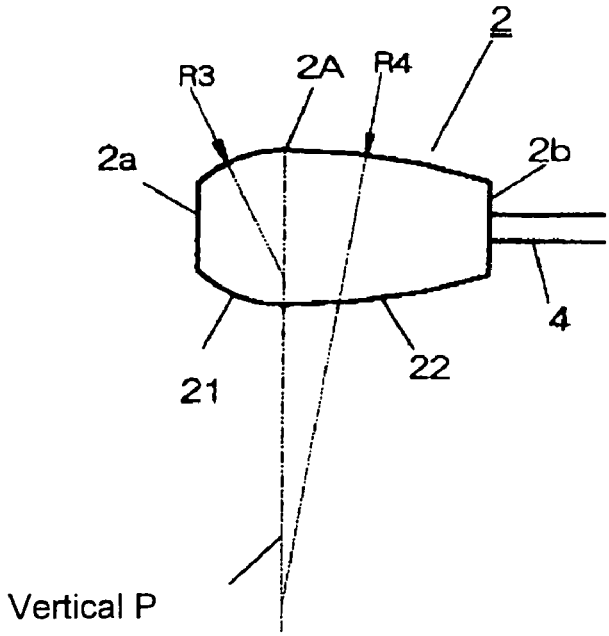
FIG. 5 shows a side view of a third embodiment of the anode.

FIG. 5 is a side view of a third embodiment of the anode of the invention. The increasing diameter portion 21 and the decreasing diameter portion 22 include curved surface portions which are shaped as bodies of revolution. That is, the arcs (R3, R4) having different middles on a vertical perpendicular P with the electrode axis (not shown) and with the portion with the maximum outside diameter 2A, have been turned around the electrode axis as an axis of rotation. In a cross section through the electrode axis, a curvature is chosen by which the boundary between the increasing diameter portion 21 and also the decreasing diameter portion 22 becomes continuous.

In this embodiment, the radius of curvature R3 of the increasing diameter portion 21 is smaller than the radius of curvature R4 of the portion with the decreasing diameter 22. In the situation in which the total electrode length is 40 mm to 50 mm and the diameter of the maximum diameter portion 2A is 25 mm, it is preferred that R3≦30 mm and R4≧30 mm.

Since the radius of curvature R4 for the decreasing diameter portion 22 is greater than the radius of curvature R3 of the increasing diameter portion 21, since the length in the axial direction of the decreasing diameter portion 22 is greater than the length in the axial direction of the increasing diameter portion 21 and since the decreasing diameter portion 22 is formed such that it has a length which is greater than or equal to ½ of the total length of the anode, it becomes possible to deflect the gas flow before widening in the radial direction occurs.

In the above described second embodiment and the above described third embodiment each anode comprises the following:

- a portion with an increasing diameter borders the tip surface of the anode and the outside diameter increases in a gently running manner to the rear;
- a portion with a maximum diameter is located on the back end of the portion with an increasing diameter and is formed by a section of a curved surface portion and
- a portion with a decreasing diameter has an outside diameter behind the portion with the maximum diameter which decreases in a gently running manner, such that each anode is provided with a gently running curved surface without discontinuous points being formed in front of and behind the portion with the maximum diameter.

Therefore, the gas flow along the surface of the anode toward the rear can be accelerated, gas flow can be induced up to the vicinity of the outer end of the arc tube and thus the gas flow speed can be reduced. Further, since the length in the axial direction of the portion with the decreasing diameter is greater than the length in the axial direction of the portion with the increasing diameter and the portion with the decreasing diameter is formed such that it has a length which is greater than or equal to ½ of the total length of the anode, the gas flow can be deflected in the direction toward the electrode middle and the widening of the gas flow in the radial direction can be suppressed.

Figure 6:
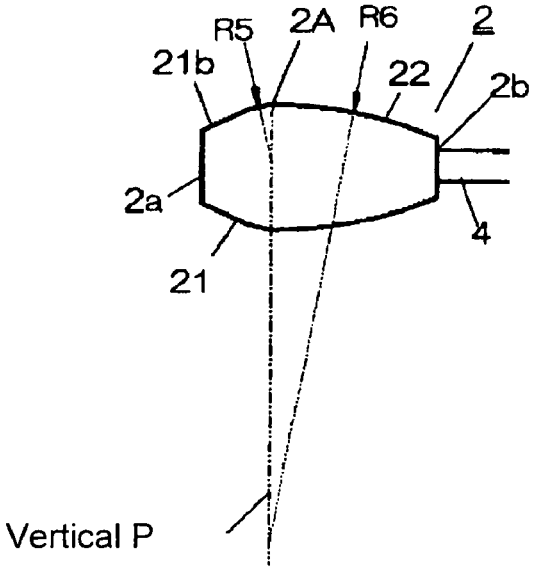
FIG. 6 shows a side view of a fourth embodiment of the anode.

FIG. 6 is a side view of a fourth embodiment of the anode. In FIG. 6, the portion with an increasing diameter 21 of the anode 2 has an obliquely running surface 21*b* which increases its diameter essentially linearly in the cross section in the axial direction. The decreasing diameter portion 22 is formed by a rotationally curved surface of an arc with a radius of curvature R6 which has its middle on a vertical perpendicular P through the portion with the maximum outside diameter 2A and perpendicular to the axial direction of the electrode axis (not shown). In the portion with the maximum outside diameter 2A which connects the portion with the increasing diameter and the portion with the decreasing diameter to one another, a curved surface R5 is formed which is used for smooth coupling to two portions. In this embodiment, thus gently running curved surfaces are formed in front of and behind the portion with the maximum outside diameter 2A. The gas flow is routed to the rear along the surface of the anode 2. Since the length of the decreasing diameter portion 22 is greater than the length of the increasing diameter portion 21, widening of the gas flow in the radial direction is prevented and the gas flow is more easily routed in the direction toward the outer end of the arc tube 11, i.e., the rear of the anode 2.

Figure 7:
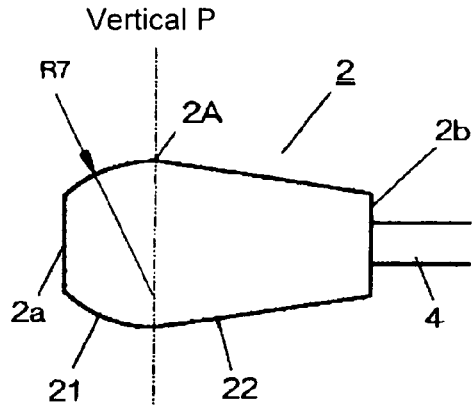
FIG. 7 shows a side view of a fifth embodiment of the anode.

FIG. 7 is a side view of a fifth embodiment of the anode of the invention. In FIG. 7, the portion with an increasing diameter 21 of the anode 2 is formed from a body of revolution, i.e., the body is turned around the electrode axis as the axis of rotation, in which an arc with a radius of curvature R7 which has its middle on a vertical perpendicular P positioned perpendicularly to the lengthwise axis of the electrode and through the portion of the anode with the maximum outside diameter 2A. On the other hand, the decreasing diameter portion 22 is formed by an obliquely running surface which adjoins the portion with the maximum outside diameter 2A and which has a diameter which decreases essentially linearly. In this embodiment, a decreasing diameter portion 22*a* curved surface portion is not formed. Reducing the curvature of the increasing diameter portion 21 (by increasing the radius of curvature R7) along with a gently running gradient for the obliquely running surface of the portion with the decreasing diameter makes it possible to form the portion with the maximum outside diameter 2A in a gently running manner. The same action of the gas flow can be obtained in this embodiment as in the above described embodiments.

Figure 8:
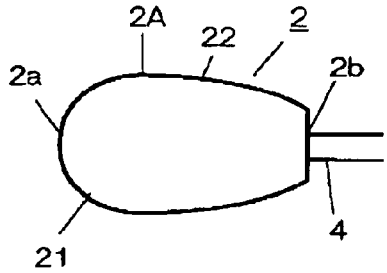
FIGS. 8(*a*) to 8(*d*) each show a side view of other embodiments of the anode.
Figure 8:
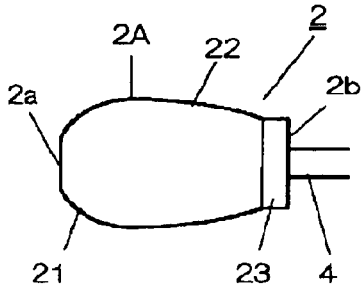
Figure 8:
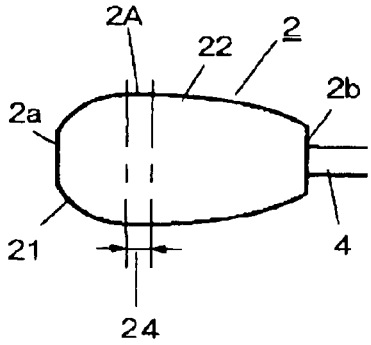
Figure 8:
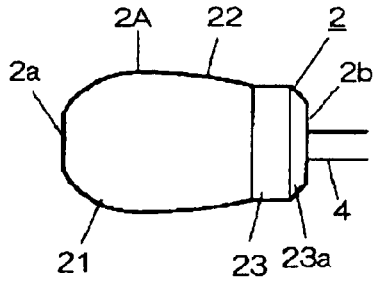

The invention is not limited to the above described embodiments, but can be changed suitably. Other embodiments are described below using FIGS. 8(*a*) to (*d*). In FIGS. 8(*a*) to (*d*) the same portions as the above described portions are provided with the same reference numbers as they and are no longer described.

As is shown in FIG. 8(*a*), the tip surface 2*a* of the anode 2 can also be shaped as a curved surface, i.e., a spheroidally curved surface which projects to the outside is advantageous as the curved surface.

In FIG. 8(*b*), behind the main portion of the anode 2, a portion with a uniform diameter 23 with a constant outside diameter on the back end 2*b* of this anode 2 is formed integrally with the anode. This portion with the uniform diameter 23 is formed in the required length so that the fabricator in the process of producing the anode 2, when working the columnar body of tungsten on a lathe into a given anode shape, can fix body in a chuck or the like. The portion with the uniform diameter 23 is a so-called "electrode grip portion". Since this portion is located behind the anode, there is no effect on the action of controlling gas flow convection of the invention. If, therefore, behind the anode the portion with the uniform diameter is formed as in this embodiment, the total length (L) of the anode is defined as the length of that area from which the portion with the uniform diameter 23 is excluded.

FIG. 8(*c*) shows an example in which a portion which corresponds to the portion with the uniform diameter 23, i.e. the "electrode grip portion", is located within the main portion of the anode 2, and in which the portion with a uniform diameter 24 is formed in the portion with the maximum outside diameter 2A. In this configuration, it is of course formed such that the length (N) (compare to FIG. 2) of the decreasing diameter portion 22 is greater than or equal to ½ of the total length (L) of the anode 2. Therefore, without forming a discontinuous point on the curved surfaces in front of and behind the portion with the maximum outside diameter 2A, a smooth fluid flow can be achieved. In this example, there is no effect on the action of controlling gas flow convection of the invention when the length of the portion 24 in the axial direction is in the range of 5% to 10% of the total electrode length.

FIG. 8(*d*) shows an example in which, in the above described example of FIG. 8(*b*), some of the portion with the uniform diameter 23 is reduced in its diameter and in which thus a tapering portion 23*a* is formed. In this example, as in the above described example as shown in FIG. 8(*b*), there is no effect on the action of controlling convection of the invention. Therefore, again the total length (L) of the anode is the length of that area from which this portion with the uniform diameter 23 is removed.

One embodiment of the invention is shown below.

The xenon lamp shown in FIG. 1 with a nominal power consumption of 6 kW in which the arc tube is filled with $1\times10^6$ Pa (25° C.) xenon gas was produced. The anode has the same arrangement as the arrangement shown in FIG. 2. The diameter of the tip area of the anode is 7 mm and the diameter of the portion with the maximum outside diameter (D) is 25 mm. The total length (L) of the anode is 40 mm, the length (M) of the portion with the increasing diameter is 14 mm and the length (N) of the portion with the decreasing diameter is 26 mm.

(Comparison Example) An anode of a conventional product was manufactured. On the side of the tip of an essentially cylindrical tungsten rod with a diameter of 25 mm and a length of 45 mm a tapering portion with a length in the axial direction of 14 mm and on the side of the back end of this tungsten rod a tapering portion of 6 mm were formed, and the electrode rod was connected to the rear end face. Electrodes and electrode rods according to this prior art, except for the arrangement of the anode, were produced in the same way as in the xenon lamp according to the above described embodiment of the invention, and thus a xenon lamp for the comparison example was produced.

The xenon lamps in the above described embodiment and the above described comparison example were operated for 750 hours and at a current value of 160 A, and the convection states were observed.

Figure 9:
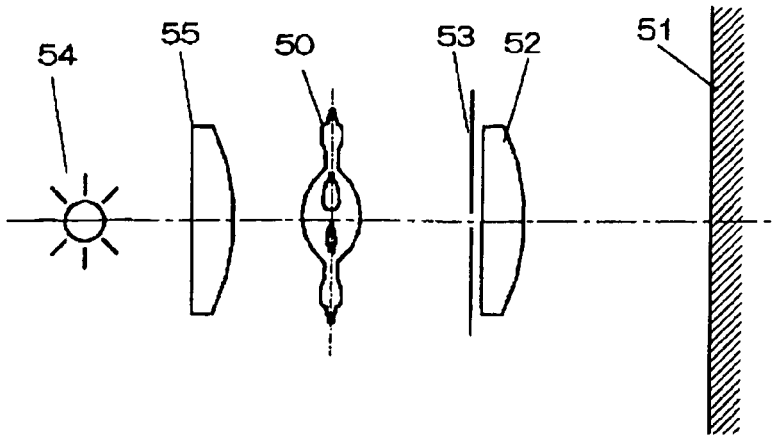
FIG. 9 shows a schematic of an experimental device which was used in one embodiment.

The convection was observed using the experimental device shown in FIG. 9. FIG. 9 is a schematic of the arrangement in which the experimental device was examined from top to bottom. First, there is a lamp 50 with which the convection is observed, and a lens 52 and a diaphragm 53 which are used for enlarged projection of the convection state onto a screen 51.

Behind the lamp 50 is a light source 54. Parallel light is produced via the lens 55 and the lamp 50 is irradiated with it. In this way, the convection state of the gas within the arc tube of the lamp 50 is projected onto the screen 51.

Figure 10:
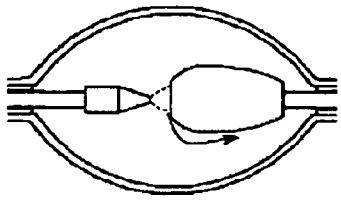
FIG. 10 shows a schematic of the result of observation of convection in a lamp according to the embodiment and in a lamp according to a comparison example.
Figure 10:
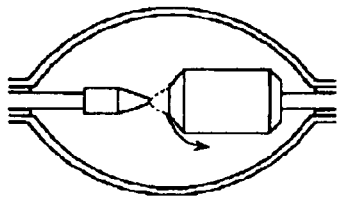
Figure 10:
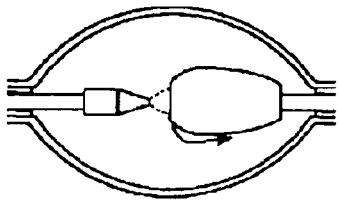
Figure 10:
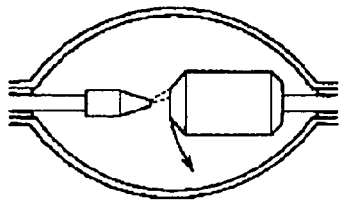

The result is shown summarized using FIG. 10. In this figure, for the sake of simplification only the gas flow underneath the anode tip which causes turbulence of the convection is shown using an arrow.

In the xenon lamp in the embodiment of the invention for FIG. 1, the convection gas flow is pointed from the vicinity of the tip area of the anode to the rear with no change in flow, even after 750 hours of operation. This confirms that the gas flow from the vicinity of the anode body flows to the top in the arc tube and that turbulence of convection rarely occur for the embodiment of the invention, such as during an operating length of the lamp of less than 1 hour.

On the other hand, in the xenon lamp in the comparison example, it was confirmed that the convection gas flow in the vicinity of the tip area of the anode flows and widens in the radial direction, and that, after extended operation, the flow in the vicinity of the tip area of the anode moves unchanged to the top of the anode where the gas flow was found to be turbulent. When this turbulence of gas flow convection occurs, the fluctuation width of the arc increased and the fluctuation of the lamp voltage became disruptively large.

Furthermore, in the above described lamps, the lamp voltage is measured after 750 hours of operation since the flicker phenomenon can be determined by the deflection width of the lamp voltage.

Figure 11:
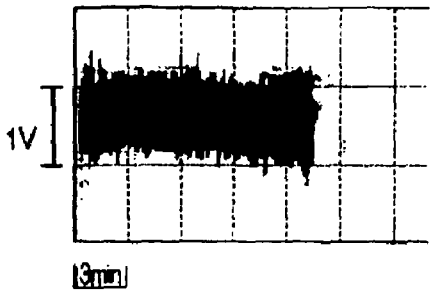
FIGS. 11(*a*) and 11(*b*) each show a schematic of the measurement result of the lamp voltage in a lamp according to the embodiment and in a lamp according to a comparison example.
Figure 11:
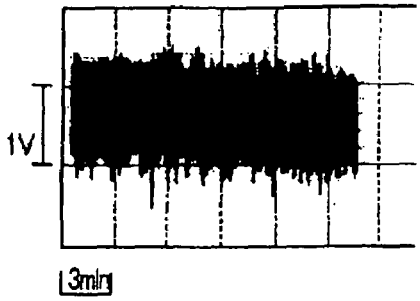
Figure 12:
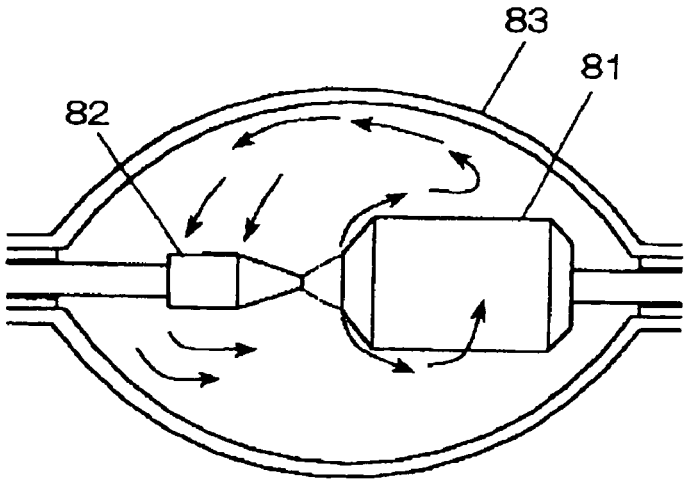
Fig. 12 (a) (Prior Art)
FIGS. 12(*a*) and 12(*b*) each show, in an enlargement, a schematic of the state of convection of a xenon lamp in the prior art.
Figure 12:
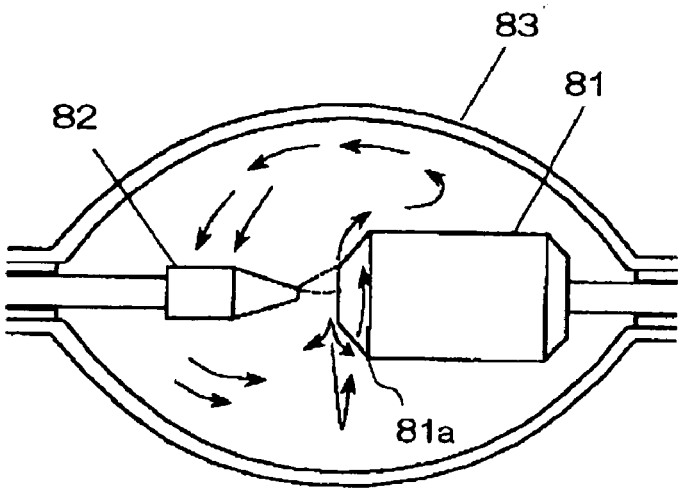
Fig. 12 (b) (Prior Art)

FIGS. 11(*a*) and 11(*b*) each show the results of measuring the lamp voltage. In FIGS. 11(*a*) and 11(*b*), the x-axis plots the time (min) and the y-axis plots the lamp voltage (V). As is shown in FIGS. 11(*a*) and 11(*b*), for the lamp voltage of the embodiment of the invention, the deflection width of the lamp voltage is improved by roughly 80% from the deflection width of the lamp voltage of the comparative example.

Finally, for the lamp in the comparison example, the flicker phenomenon occurred at 750 hours of operation; while, it was confirmed that for the lamp in the embodiment of the invention the flicker phenomenon did not occur even at 1000 hours of operation.

In the xenon lamp of the invention, the convective gas flow travels smoothly to the rear along the anode body. The gas flows over the vicinity of the outer end of the arc tube, resulting in the state in which the speed of the gas flow in the vicinity of the arc is reduced. Thus, the phenomenon that the arc fluctuates by convection is reduced and a stable state of the arc can be maintained over a long period of time. As a result, the time until formation of the flicker phenomenon, i.e., the flicker service life, can be prolonged.

What is claimed is:

1. A xenon lamp which is adapted for operation in a horizontal orientation comprising:

an arc tube provided with a side tube portion at each end;

xenon gas within the arc tube;

an anode and an opposed cathode located within the arc tube spaced a predetermined distance from each other, the anode and cathode being differently configured; and an electrode rod connected to a back end of the anode and extending to an adjacent side tube portion and another electrode rod connected to a back end of the cathode and extending to an adjacent side tube portion, wherein the anode comprises:

a flattened or rounded anode tip that is free of protrusions directed toward the cathode;

a rounded or flattened back end;

a portion with a gradually increasing diameter in which the gradual increasing diameter gradually increases in diameter from the anode tip toward the back end;

a portion with a gradually decreasing diameter extending toward the back end of the anode in which the gradually decreasing diameter gradually decreases in the direction toward the back end and a length, in an axial direction of the portion with a gradually decreasing diameter, which is greater than the length in the axial direction of the portion with an increasing diameter; and a portion with a maximum outside diameter which is located in a transition area between the portion with the increasing diameter and the portion with a decreasing diameter, and wherein the transition area between the portion with the increasing diameter and the portion with the decreasing diameter is of a continuous profile.

2. A xenon lamp which comprising:

an arc tube with a side tube portion at each end;

xenon gas within the arc tube;

an anode and an opposed cathode located within the arc tube spaced a predetermined distance from each other; and an electrode rod connected to a back end of the anode and extending to an adjacent side tube portion and another electrode rod connected to a back end of the cathode and extending to an adjacent side tube portion, wherein the anode comprises:

a flattened or rounded anode tip;

a rounded or flattened back end;

a portion with a gradually increasing diameter in which the gradual increasing diameter gradually increases in diameter from the anode tip toward the back end;

a portion with a gradually decreasing diameter extending toward the back end of the anode in which the gradually decreasing diameter gradually decreases in the direction toward the back end and a length, in an axial direction of the portion with a gradually decreasing diameter, which is greater than the length in the axial direction of the portion with an increasing diameter; and a portion with a maximum outside diameter which is located in a transition area between the portion with the increasing diameter and the portion with a decreasing diameter, and wherein the transition area between the portion with the increasing diameter and the portion with the decreasing diameter is of a continuous profile; and wherein the portion with the increasing diameter and the portion with the decreasing diameter are each formed with a substantially arc-shaped, rotationally curved surface, and wherein the relationship R3<R4 is satisfied when R3 is the radius of curvature of the curved surface of the portion with the increasing diameter and R4 is the radius of curvature of the curved surface of the portion with the decreasing diameter.

3. The xenon lamp as claimed in claim 1, wherein the relationship L>D is satisfied when L (mm) is the length in the axial direction from the anode tip to the back end of the anode and D (mm) is the diameter of the portion with the maximum outside diameter.

4. The xenon lamp as claimed in claim 1, wherein the diameter of the portion with the increasing diameter increases substantially linearly, the diameter of the portion with a decreasing diameter decreases substantially linearly, and the surface of the anode in the transition area between the portion with the increasing diameter and the portion with the decreasing diameter is formed as a substantially arc-shaped, rotationally curved surface.

5. The xenon lamp as claimed in claim 1, wherein the diameter of the portion with an increasing diameter increases substantially linearly, the surface of the portion with a decreasing diameter is formed with a substantially arc-shaped, rotationally curved surface and the surface of the anode in the transition area between the portion with the increasing diameter and the portion with a decreasing diameter is formed with a substantially arc-shaped, rotationally curved surface.

6. The xenon lamp as claimed in claim 1, wherein the portion with an increasing diameter is formed with a substantially arc-shaped, rotationally curved surface and the diameter of the portion with a decreasing diameter decreases substantially linearly.

7. The xenon lamp as claimed in claim 1, wherein the portion with a decreasing diameter adjoins a portion of the anode having a uniform diameter.

8. The xenon lamp as claimed in claim 7, wherein the portion with a decreasing diameter adjoins the portion with a uniform diameter at the back end of the anode.

9. The xenon lamp as claimed in claim 7, wherein the portion with the uniform diameter adjoins the portion with a decreasing diameter at the portion with a maximum diameter.

10. The xenon lamp as claimed claim 1, wherein the length in the axial direction of the portion with the decreasing diameter is greater than or equal to one half of the total length of the anode.

* * * * *